US008678528B2

(12) United States Patent
Domenig et al.

(10) Patent No.: US 8,678,528 B2
(45) Date of Patent: Mar. 25, 2014

(54) CONTROL MECHANISM FOR DRAWER SLIDE ASSEMBLY

(75) Inventors: Georg Domenig, Kernersville, NC (US); Manfred Peer, Walkertown, NC (US); Jeffery Morgan, High Point, NC (US)

(73) Assignee: Grass America, Inc., Kernersville, NC (US)

( * ) Notice: Subject to any disclaimer, the term of this patent is extended or adjusted under 35 U.S.C. 154(b) by 391 days.

(21) Appl. No.: 13/011,269

(22) Filed: Jan. 21, 2011

(65) Prior Publication Data

US 2011/0115353 A1 May 19, 2011

Related U.S. Application Data

(60) Provisional application No. 61/083,219, filed on Jul. 24, 2008.

(51) Int. Cl.
*A47B 88/00* (2006.01)

(52) U.S. Cl.
USPC ..... 312/334.44; 312/319.1; 312/333

(58) Field of Classification Search
USPC ..... 312/319.1, 330.1, 333, 334.1, 334.7, 312/334.8, 334.12, 334.18, 334.21, 334.44, 312/334.45, 334.46, 334.47; 384/10, 19, 21
See application file for complete search history.

(56) References Cited

U.S. PATENT DOCUMENTS 5,474,375 A * 12/1995 Hollenstein et al. ..... 312/319.1
6,712,435 B2 * 3/2004 Kim et al. ..... 312/319.1
7,244,005 B1 * 7/2007 Lu ..... 312/333
2001/0008037 A1 * 7/2001 Brustle ..... 16/71
2003/0189395 A1 * 10/2003 Doornbos et al. ..... 312/334.1
2003/0234604 A1 12/2003 Lin et al.
2004/0000850 A1 * 1/2004 Lam Harn et al. ..... 312/333
2004/0144604 A1 * 7/2004 Doornbos et al. ..... 188/290
2005/0231083 A1 10/2005 Garcie, Jr.

(Continued)

FOREIGN PATENT DOCUMENTS

CN 2 879 810 3/2007
DE 93 11 238 9/1993
DE 20 2004 018189 3/2005

OTHER PUBLICATIONS

European Search Report, European Application No. 09800997.0, dated Mar. 28, 2012 (8 pages).

(Continued)

*Primary Examiner* — Darnell Jayne
*Assistant Examiner* — Sasha T Varghese
(74) *Attorney, Agent, or Firm* — Burr & Brown, PLLC

(57) ABSTRACT

A drawer slide assembly control mechanism including a cabinet rail and a drawer rail is provided, the control mechanism including a drawer latch bracket associated with one of the drawer and the drawer rail and having an engagement tab extending outwardly therefrom, and a shock-absorbing sub-assembly. The shock-absorbing sub-assembly includes an elongate bracket member associated with the cabinet rail and capable of limited linear movement along a portion of the cabinet rail, a movable latch associated with the elongate bracket member and cooperating with the engagement tab of the drawer latch so as to move in concert with movement of the drawer rail over at least a portion of a length of the drawer rail, and a shock absorber associated with the elongate bracket member and cooperating with the movable latch for damping movement of the movable latch at least during a closing stroke of the drawer rail.

10 Claims, 13 Drawing Sheets

(56) References Cited

U.S. PATENT DOCUMENTS

| | | | | |
|---|---|---|---|---|
| 2006/0113169 | A1 | 6/2006 | Leon et al. | |
| 2006/0279182 | A1* | 12/2006 | Chi Ming | 312/219 |
| 2007/0046159 | A1 | 3/2007 | Hoffman | |
| 2007/0132346 | A1* | 6/2007 | Huang | 312/333 |
| 2009/0160299 | A1* | 6/2009 | Chen et al. | 312/334.44 |
| 2009/0195131 | A1* | 8/2009 | Chi et al. | 312/319.1 |
| 2009/0273263 | A1* | 11/2009 | Berger | 312/334.1 |

OTHER PUBLICATIONS

Chinese Second Office Action, (with English Translation), Chinese Application No. 200980124505.6, dated Jan. 31, 2013 (21 pages).

Chinese Office Action mailed Jun. 5, 2012 (with English Translation).

Chinese Office Action (With English Translation), Chinese Application No. 200980124505.6, dated Aug. 26, 2013 (20 pages).

* cited by examiner

CONTROL MECHANISM FOR DRAWER SLIDE ASSEMBLY

FIELD OF THE INVENTION

The present invention relates generally to slide assemblies used in connecting drawers to cabinets, and more particularly relates to a control mechanism to dampen the movement of a drawer slide assembly as it is closed within the cabinet housing.

BACKGROUND OF THE INVENTION

Drawer slide assemblies are used in most drawer-cabinet settings to facilitate a smooth opening and closing of a drawer relative to the cabinet housing. The problem with such drawer slide assemblies, however, is that they lack means for providing any sort of control over the movement of the drawer as it closes in the cabinet housing. As such, the drawer, cabinet, or a facia cover associated with the front of the drawer, can be damaged as the drawer is forcibly closed into the cabinet housing.

Such forceful movement of the drawer relative to the cabinet housing can also cause loud slamming noises upon impact between the drawer and the cabinet interface, and there can be damage to the associated drawer slide assembly mechanisms and rails, or the contents of the drawers themselves. It is clear that such uncontrolled closing motion is undesirable, and it is equally clear that it would be desirable to prevent such uncontrolled forceful movement of the drawer upon closing and the damage associated therewith.

SUMMARY OF THE INVENTION

It is an object of the present invention to provide a control mechanism in conjunction with a drawer slide assembly having a wheeled rolling mechanism that inhibits such forceful movement of the drawer relative to the cabinet housing and effectively prevents the damage and undesirable noise associated with otherwise uncontrolled closing movement.

According to one embodiment of the present invention, a drawer slide assembly control mechanism is provided, including a cabinet rail and a drawer rail including a wheeled rolling mechanism. The control mechanism comprises a drawer latch bracket positioned on at least one of the drawer rail and a drawer associated with the drawer rail. The drawer latch bracket has an engagement tab extending substantially perpendicularly from a main plan thereof. The control mechanism also includes a shock-absorbing sub-assembly comprising an elongate bracket member associated with the cabinet rail and capable of limited linear movement along a portion of the cabinet rail, a movable latch associated with the elongate bracket member and cooperating with the engagement tab of the drawer latch so as to move in concert with movement of the drawer rail over at least a portion of a length of the drawer rail, and a shock absorber associated with the elongate bracket member and cooperating with the movable latch for damping movement of the movable latch at least during a closing stroke of the drawer rail.

Preferably, the elongate bracket member comprises at least one groove having a main portion extending in a direction that is substantially parallel with respect to an extension axis of the cabinet rail and having a terminal end with an angular bent portion that deviates from the extension direction.

It is also preferred that the movable latch comprises at least a first post extending outwardly therefrom in a direction that is substantially perpendicular to the extension axis of the cabinet rail and that resides in and rides along the at least one groove of the elongate bracket member, a catcher extending outwardly in an angled manner from an upper forward end of the movable latch proximate the at least one post, a member for engaging the shock absorber, and a space between the catcher and the member for engaging the shock absorber.

It is more preferred that the elongate bracket member comprises at least two of the grooves, and the movable latch comprises at least a second post associated with a second one of the at least two grooves.

According to one aspect of the present invention, the elongate bracket member comprises mating means for engaging corresponding mating means provided on the cabinet rail to establish a secure, snap-fit, mated structure, and the drawer latch bracket comprises mating means for engaging corresponding mating means provided on the drawer rail to establish a secure, snap fit, mated structure.

According to one aspect of the present invention, the mating means of the elongate bracket member comprise a plurality of protrusions having shapes that matingly fit and lockingly engage the corresponding mating means on the cabinet rail, which comprise corresponding openings, and the mating means of the drawer latch bracket comprises a plurality of protrusions having shapes that matingly fit and lockingly engage the corresponding mating means on the drawer rail, which comprise corresponding openings.

According to another embodiment of the present invention, a control mechanism for a drawer slide assembly including a cabinet rail and a drawer rail is provided, the control mechanism comprising a latch bracket that moves with the drawer rail, a latch associated with the cabinet rail and being configured to move along with movement of the drawer rail when in a latched state, and a damper for damping movement of the latch at least when the drawer rail is moving from an open position to a closed position.

According to another embodiment of the present invention, a control mechanism for a drawer slide assembly including a cabinet rail and a drawer rail is provided, the control mechanism comprising a latch bracket positioned on at least one of the drawer rail and a drawer associated with the drawer rail, the latch having a post extending therefrom, a latch associated with the cabinet rail and capable of limited linear movement along a portion of the cabinet rail, the latch cooperating with the post so as to move along with movement of the drawer rail when latched on the post, and a damper for damping movement of the latch at least when the drawer rail is moving from an open position to a closed position.

DETAILED DESCRIPTION OF THE INVENTION

Figure 1:
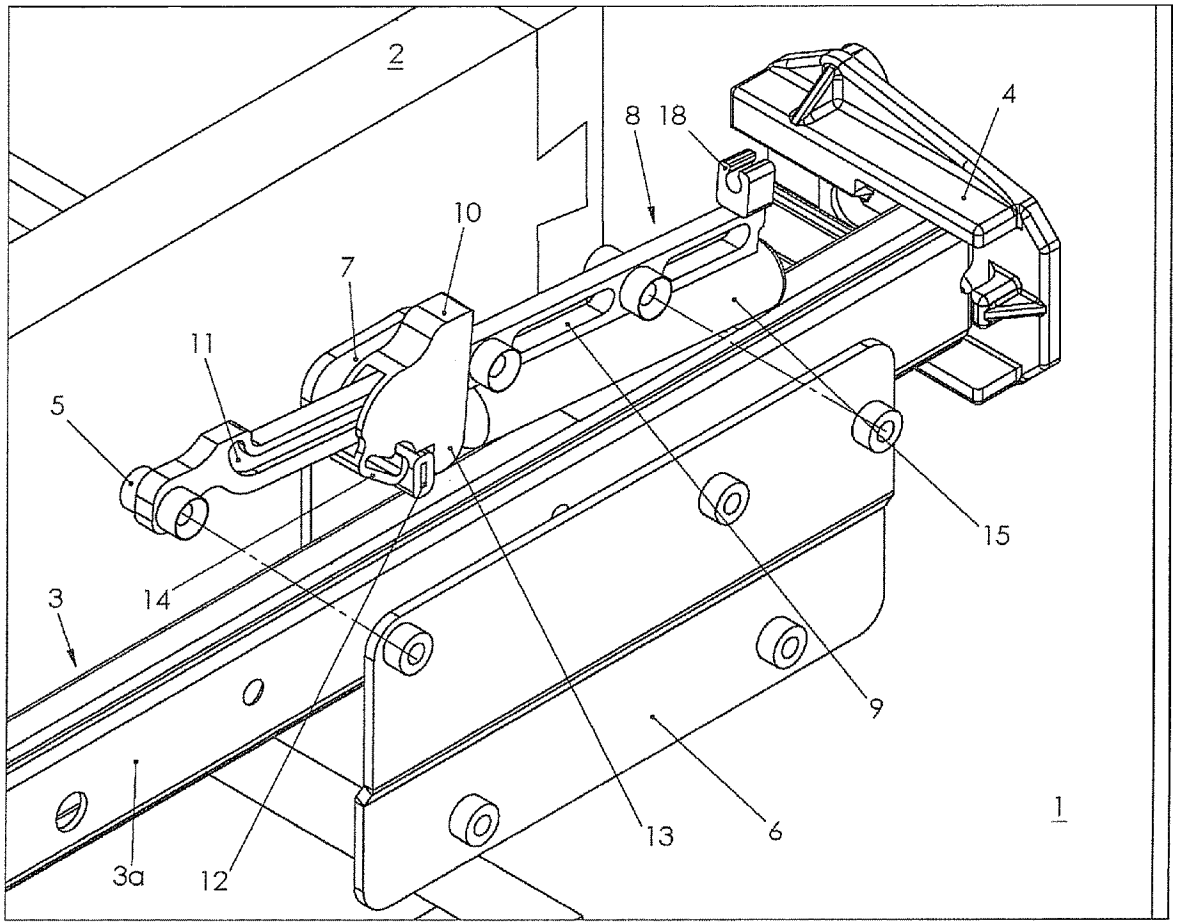
FIG. 1 is a partial exploded, perspective view of a drawer slide control mechanism 5 according to one embodiment on the present invention.

FIG. 1 shows a drawer slide control mechanism 5 according to one embodiment of the present invention. The control mechanism is designed to work in concert with a conventional drawer slider assembly that is used to control the movement of a drawer 2 relative to a cabinet housing 1 (see U.S. Pat. No. 5,257,861, for example). The conventional assembly includes slide rails 3, which include a cabinet rail 3*a* that is fixed to the cabinet housing 1 via a cabinet housing bracket 4, and a drawer rail 3*b* (FIG. 2) that is attached to the drawer 2, in any known manner. For example, the drawer rail 3*b* can a separate member that is affixed to the side surface of the drawer (e.g., such as a side-mount roller or slide rail system), or it be formed as an integral part of a metal or plastic side surface of the drawer itself, extending outwardly therefrom along the length thereof, rather than as a separate member affixed thereto. In any event, the essential structural components of the drawer rail 3*b* remain the same regardless of whether it is separately mounted or an integral component with respect to the side surface of the drawer.

The control mechanism 5 shown in FIG. 1 includes a cabinet rail bracket 6. The cabinet rail bracket 6 can be fixed to the cabinet rail 3*a* by a number of different means, such as via the two fasteners 6*a*, 6*b* shown in FIG. 1. The cabinet rail bracket 6 can also be fixed or attached to the cabinet rail 3*a* by other means, suitable examples of which include, but are not limited to, welding, gluing, adhesive tape, an adhesive-backed or glue-backed hook-and-loop type fastener member, or the cabinet rail bracket 6 can be formed integrally with the cabinet rail 3*a* by casting, for example.

The control mechanism 5 also includes a drawer latch bracket 7 that is fixed at least to the drawer rail 3*b*, as explained in more detail below.

Figure 2:
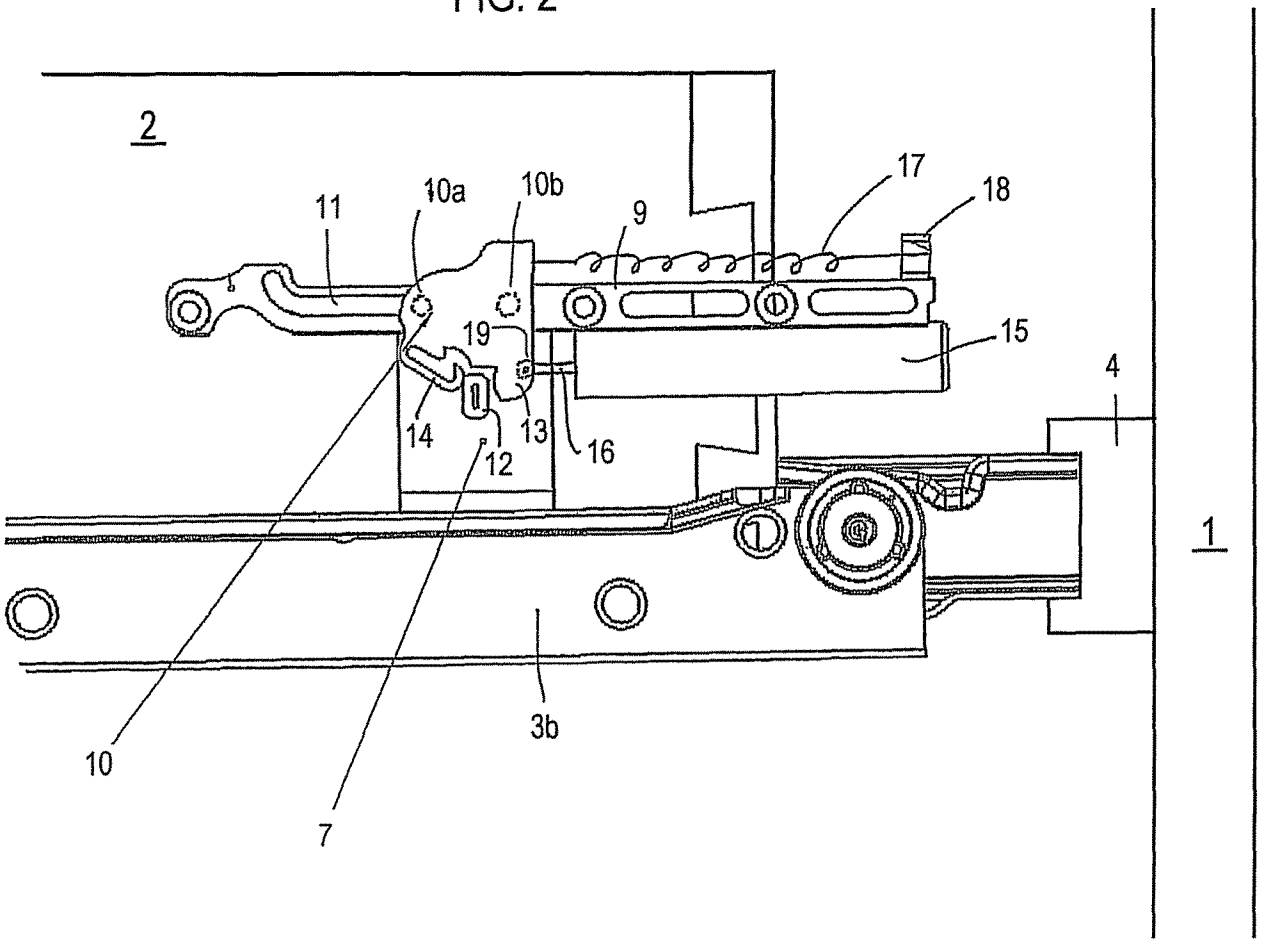
FIG. 2 is a side view of the control mechanism shown in FIG. 1, with the cabinet rail 3*a* and the cabinet rail bracket 6 removed.

The control mechanism 5 also includes a shock absorbing sub-assembly 8 having an elongate bracket 9 and a moveable latch 10 (see FIGS. 1 and 2). The movable latch 10 includes an internal post 10*a* that resides and rides within J-grooves 11 formed on at least one side of the elongate bracket 9. If two J-grooves 11*a*, 11*b* are be formed on both sides of bracket 9, two pairs of internal posts 10*a*, 10*b* would be provided on opposing inner faces of latch 10. The latch 10 includes a stopper or catcher 13 and a spring finger 14 that sandwich a post member 12 that extends perpendicularly from the main plane of a drawer latch bracket 7 that is attached to the drawer rail 3*b*.

The shock absorbing sub-assembly 8 also includes a shock absorber 15 having a piston rod 16 that is pivotally connected to latch 10, by pin 19, for example. The shock absorber can include any type of fluid, such as a gas or a liquid, like air or oil or any other suitable dampening means.

Figure 3:
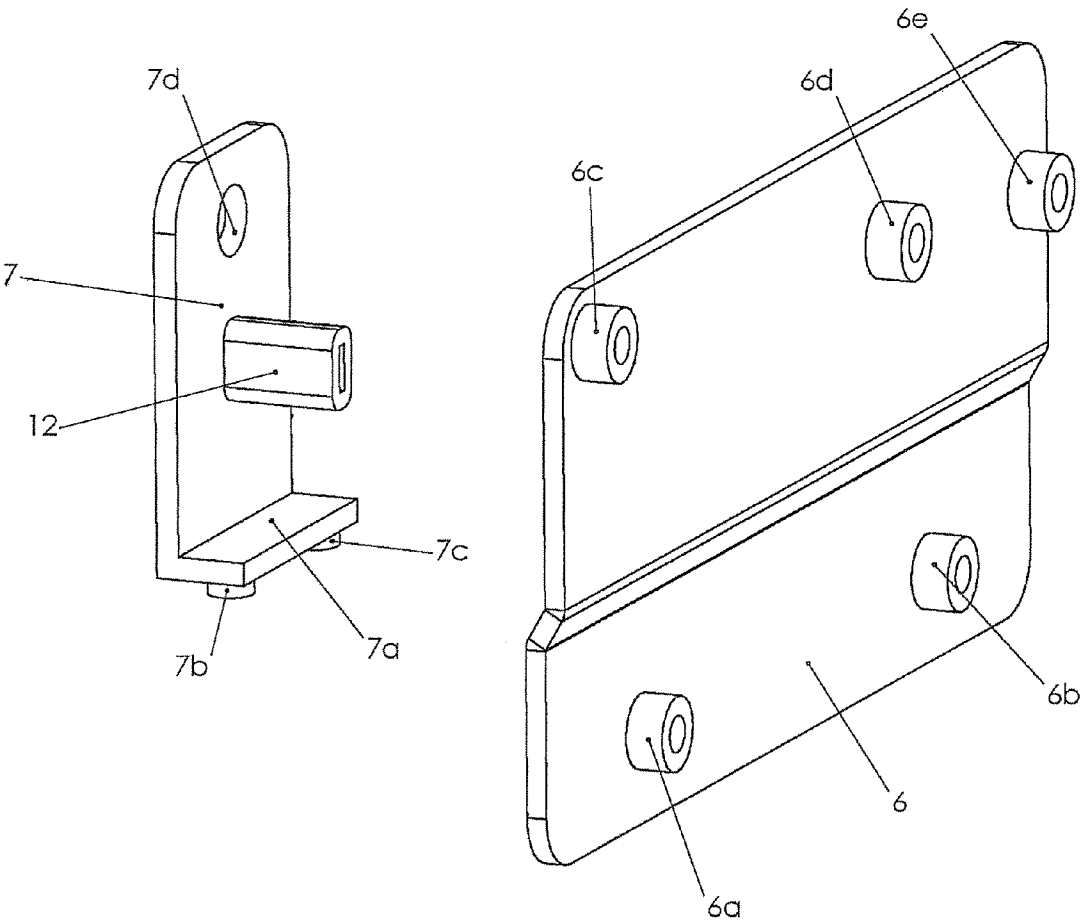
FIG. 3 is a perspective view showing the cabinet rail bracket 6 and the drawer latch bracket 7.

The shock absorbing sub-assembly 8 is attached to the upper portion of cabinet rail bracket 6 by three fasteners 6*c*, 6*d* and 6*e* (see FIG. 3). Although fasteners 6*c*-6*e* are shown arranged in an inclined manner, it is preferred that the fasteners lie in a line parallel to the upper surface of cabinet rail bracket 6 so that shock absorbing sub-assembly 8 is oriented substantially parallel to the rails 3. The means for affixing the elongate bracket 9 of shock absorbing sub-assembly 8 to cabinet rail bracket 6 is not limited, and can include other means, such as welding, gluing, adhesive tape, an adhesive-backed or glue-backed hook-and-loop type fastener member, or formed integrally by casting, for example. A drawer return spring 17 (see FIG. 2) extends from a holding member 18 fixed to a rear portion of the elongate bracket 9, and is attached to an upper portion of the latch 10.

FIG. 3 shows the details of the cabinet rail bracket 6 and the drawer latch bracket 7. The drawer latch bracket 7 includes a main planar portion from which the post member 12 extends perpendicularly. The drawer latch bracket 7 also includes a stabilizing foot 7*a*, which is a protursion extending outwardly from a lower portion of the main plane of the drawer latch bracket 7. The bottom surface of the stabilizing foot 7*a*. includes a plurality of snap-fit mating members 7*b*, 7*c* extending downwardly therefrom, to affix the drawer latch bracket 7 to corresponding mating members, such as, protrusions, in the drawer rail 3*b*. FIG. 3 also shows that the drawer latch bracket 7 can also include a hole 7*d* for direct connection to drawer 2 via a screw, for example. The means for affixing the drawer latch bracket 7 is not limited, and can include other means, such as welding, gluing, adhesive tape, an adhesive-backed or glue-backed hook-and-loop type fastener member, for example. An example of another latch bracket 700 according to a different embodiment of the present invention is shown in FIG. 6A. In this case, the latch bracket 700 is adapted to be affixed to the back panel of the drawer, which is typically wooden, so that a single, universal latch bracket 700 can be used in conjunction with metal-sided drawers of different heights, as described in more detail below. As shown in FIG. 6A, the latch bracket 700 is not affixed to the metal drawer member 300, but is instead adapted to be affixed, through the various means described above, to the fixed wooden back panel of the drawer (not shown) at location 721, for example, and/or at locations 723, 724 of the extension 722. It should also be noted, however, that the latch bracket 700 can just as readily be affixed to the drawer member 300, at locations 723, 724, for example, as discussed in more detail below.

Figure 4:
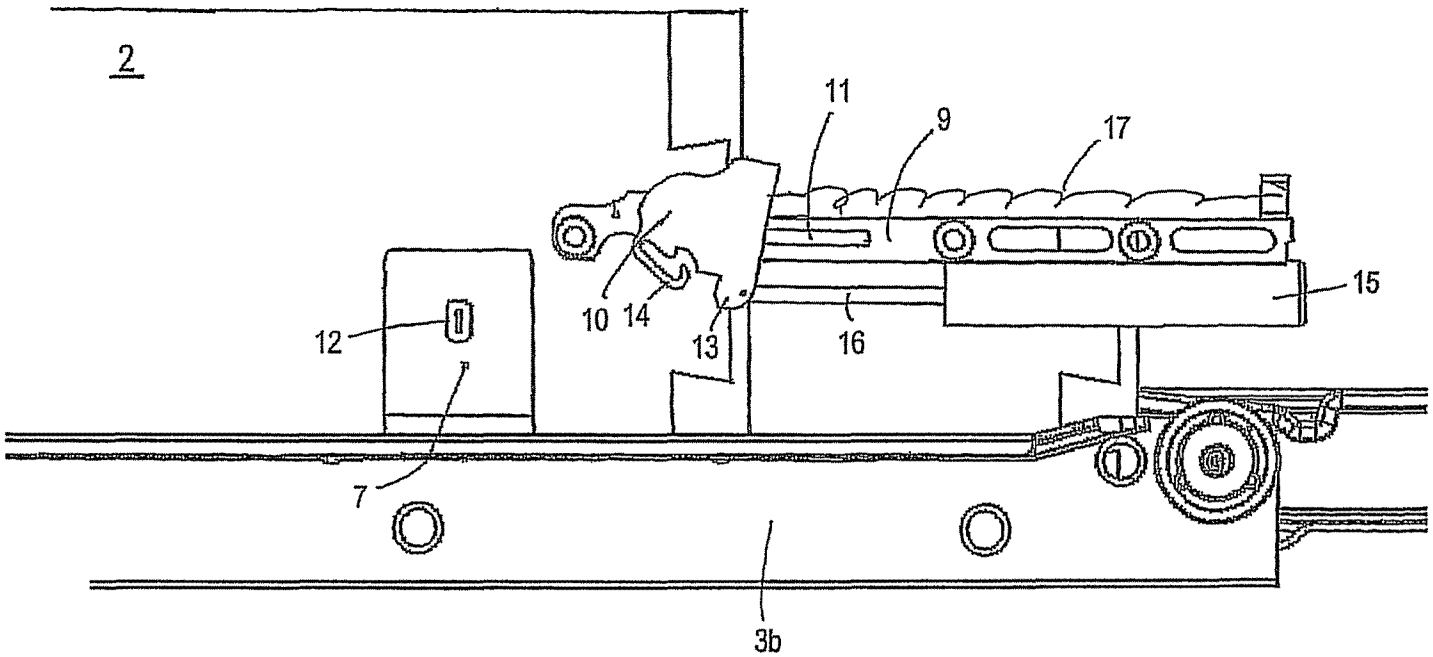
FIG. 4 is a view similar to FIG. 2, but showing the latch 10 in a fully-extended position.

The operation of the drawer slide control mechanism 5 according to the above-described embodiment of the present invention will now be explained with reference to FIGS. 2 and 4. FIG. 2 shows the drawer 2 in the fully closed position, whereas FIG. 4 shows the drawer 2 in an open position. It should also be noted that the post 712 of the latch bracket 700 shown in FIGS. 6A and 6B functionally interacts in the same manner described below with respect to the embodiment shown in FIGS. 2 and 4.

As the drawer 2 is opened and moves away from the cabinet housing 1, post 12 extending from the drawer latch bracket 7 engages the spring finger 14 forces the movable latch 10 to slide along the J-groove 11 until the forward internal post 10*a* of the movable latch 10 rests within the tip end of the J-groove 11, as shown in FIG. 4. At this terminal point, the forward end of the movable latch 10 has been lifted upwardly to a sufficient degree so that the post 12 clears spring finger 14 and moves therepast. This, in turn, allows the drawer 2 to be fully opened relative to the cabinet housing 1 (see FIG. 4). In view of the fact that the terminal end of J-groove 11 is shaped such that it performs a temporary locking function with respect to the position of the latch 10, and the position of the latch 10 will be maintained as shown in FIG. 4 until the drawer 2 is closed.

When the drawer 2 is closed, the post 12 on the drawer latch bracket 7 engages the stop 13 on the latch 10 and forces the internal post 10*a* out of the terminal end portion of the J-groove 11. At this point, the drawer return spring 17 draws the latch 10 back toward the cabinet housing 1 until the drawer 2 is fully closed. The shock absorber 15 dampens the return stroke of the latch 10, and thus the drawer 2, so that the drawer 2 does not close abruptly with respect to cabinet housing 1. The result is a smooth and gentle closing action of the drawer 2 relative to cabinet housing 1.

In the event that internal post 10*a* is dislodged from the temporary locking position provided by the terminal end portion of the J-groove 11, which would force the latch 10 back to the initial position shown in FIG. 2, it would still be possible to return drawer 2 to its fully closed position manually. Specifically, the spring finger 14 is resilient enough to allow post 12 to deflect spring finger 14 upwardly to a sufficient extent to allow post 12 to clear the spring finger 14 to essentially reset the position of the post 12 so as to be sandwiched between stop 13 and spring finger 14. At this point, the drawer slide control mechanism 5 is reset and again ready for use in the manner described above.

Figure 5:
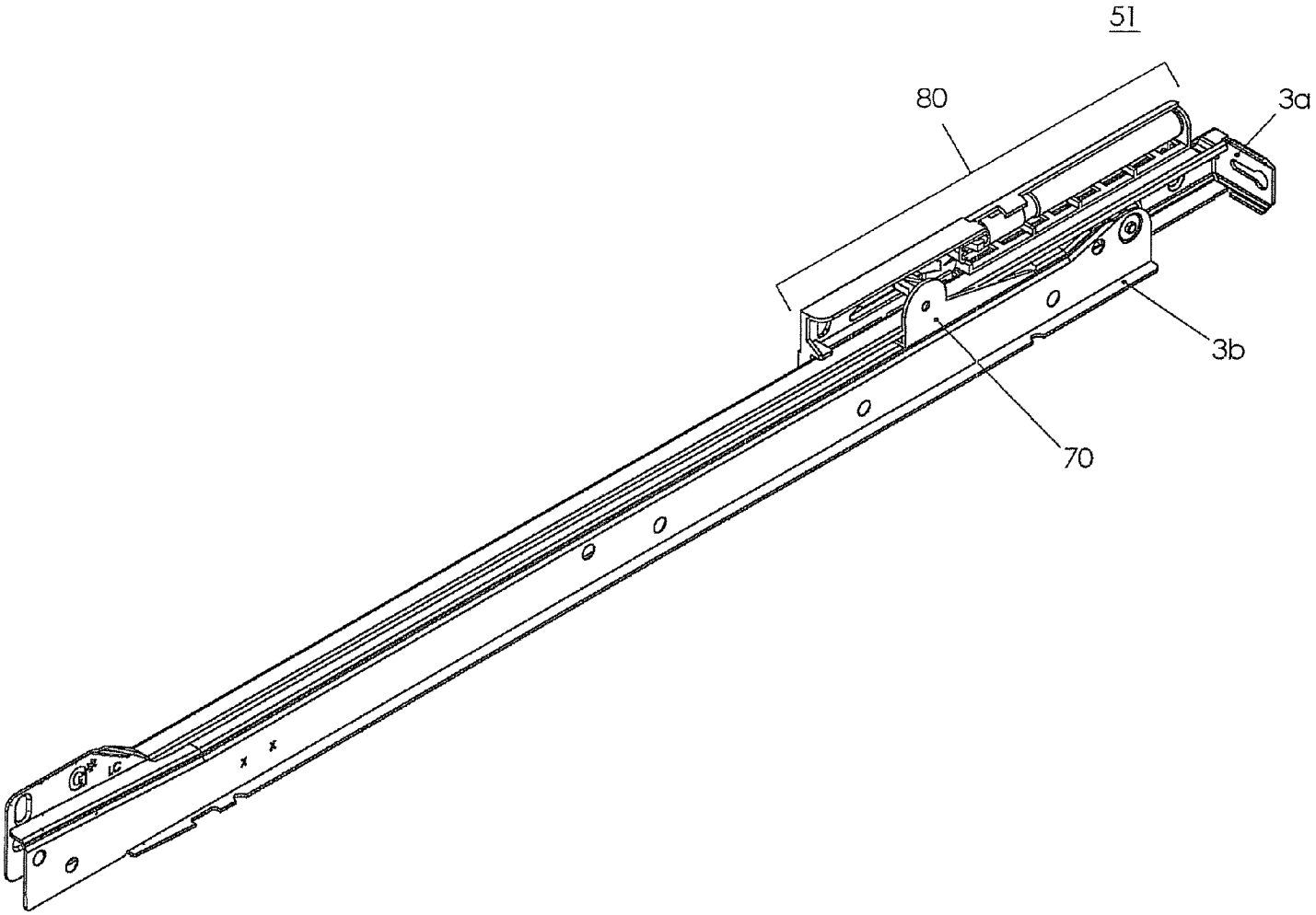
FIG. 5 is a perspective view of a drawer slide control mechanism 51 according to another embodiment of the present invention in the closed state.
Figure 6:
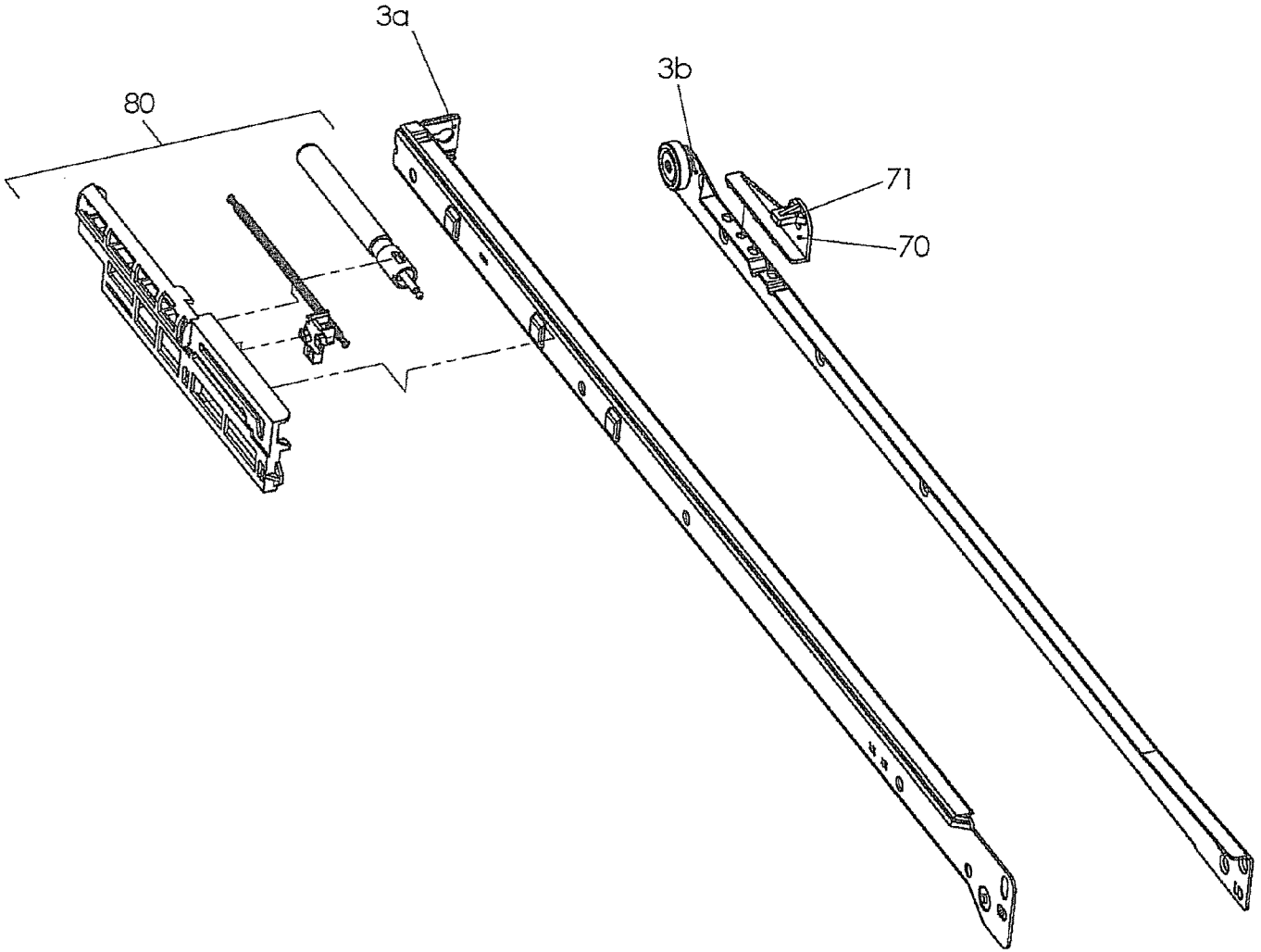
FIG. 6 is an exploded cabinet-side view of the control mechanism 51 shown in FIG. 5.
Figure 6A:
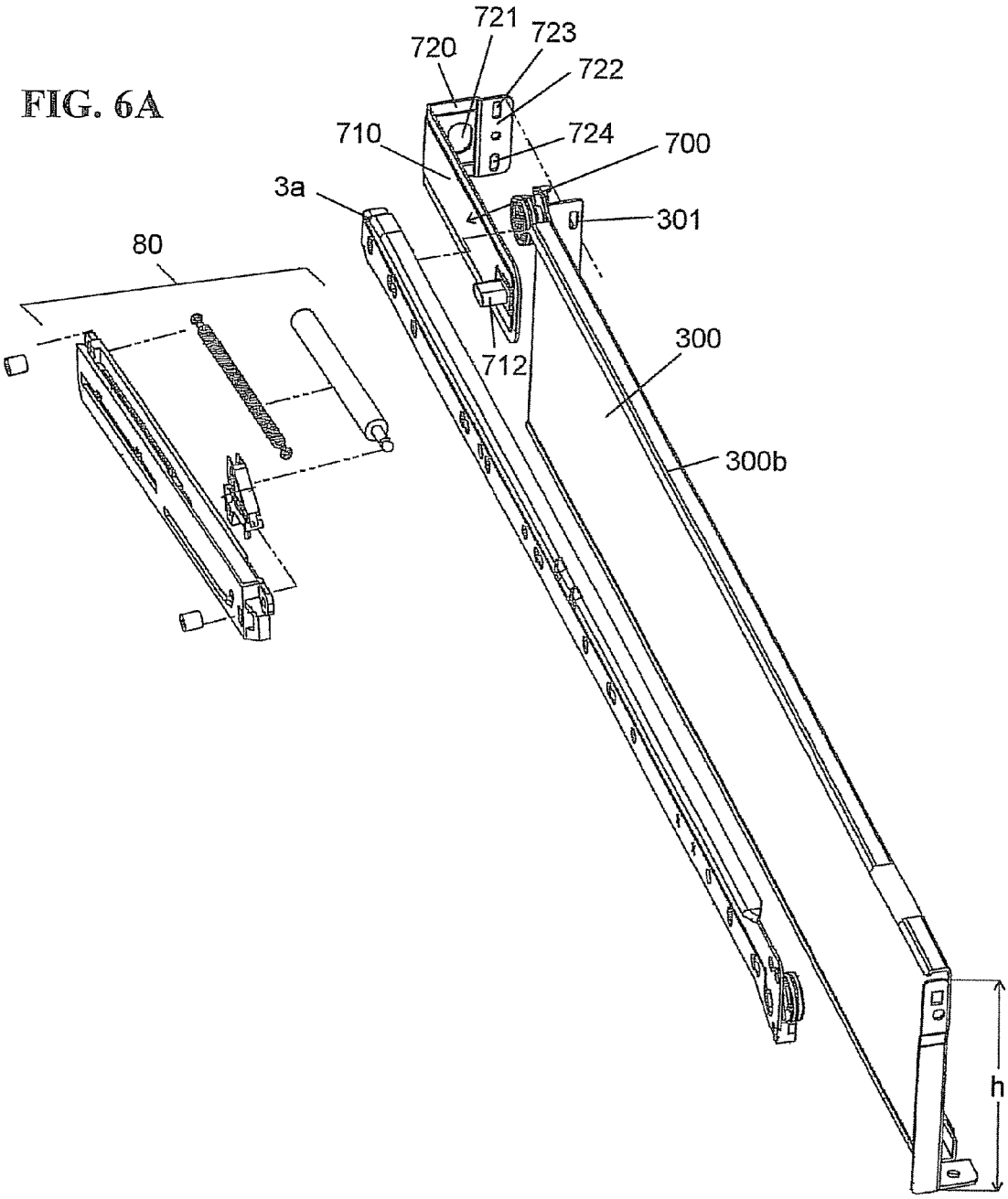
FIG. 6A is an exploded cabinet-side view of a control mechanism including a different latch bracket according to another embodiment of the present invention.
Figure 7:
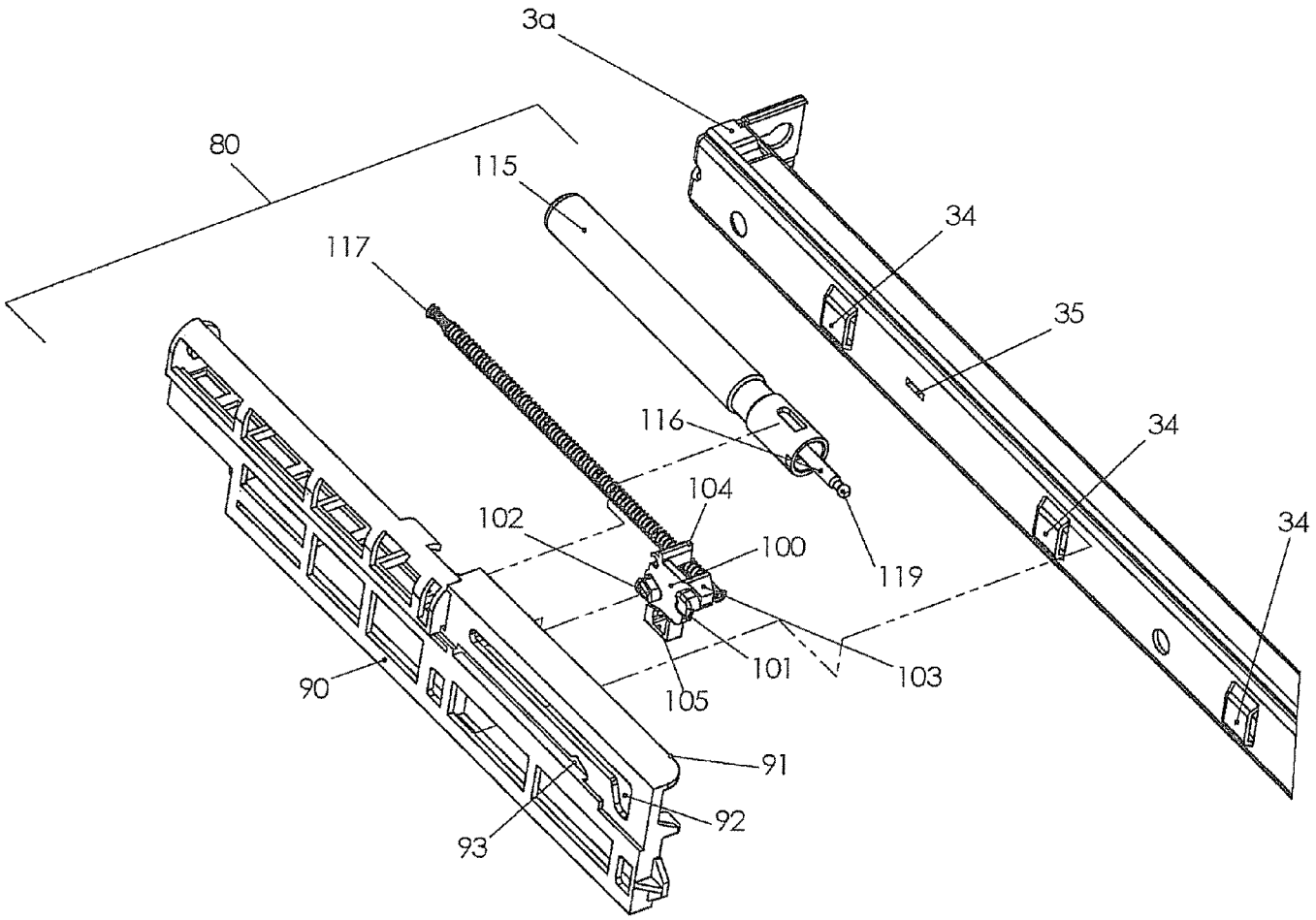
FIG. 7 is an enlarged, exploded cabinet-side view of the shock absorbing sub-assembly shown in FIG. 6.
Figure 8:
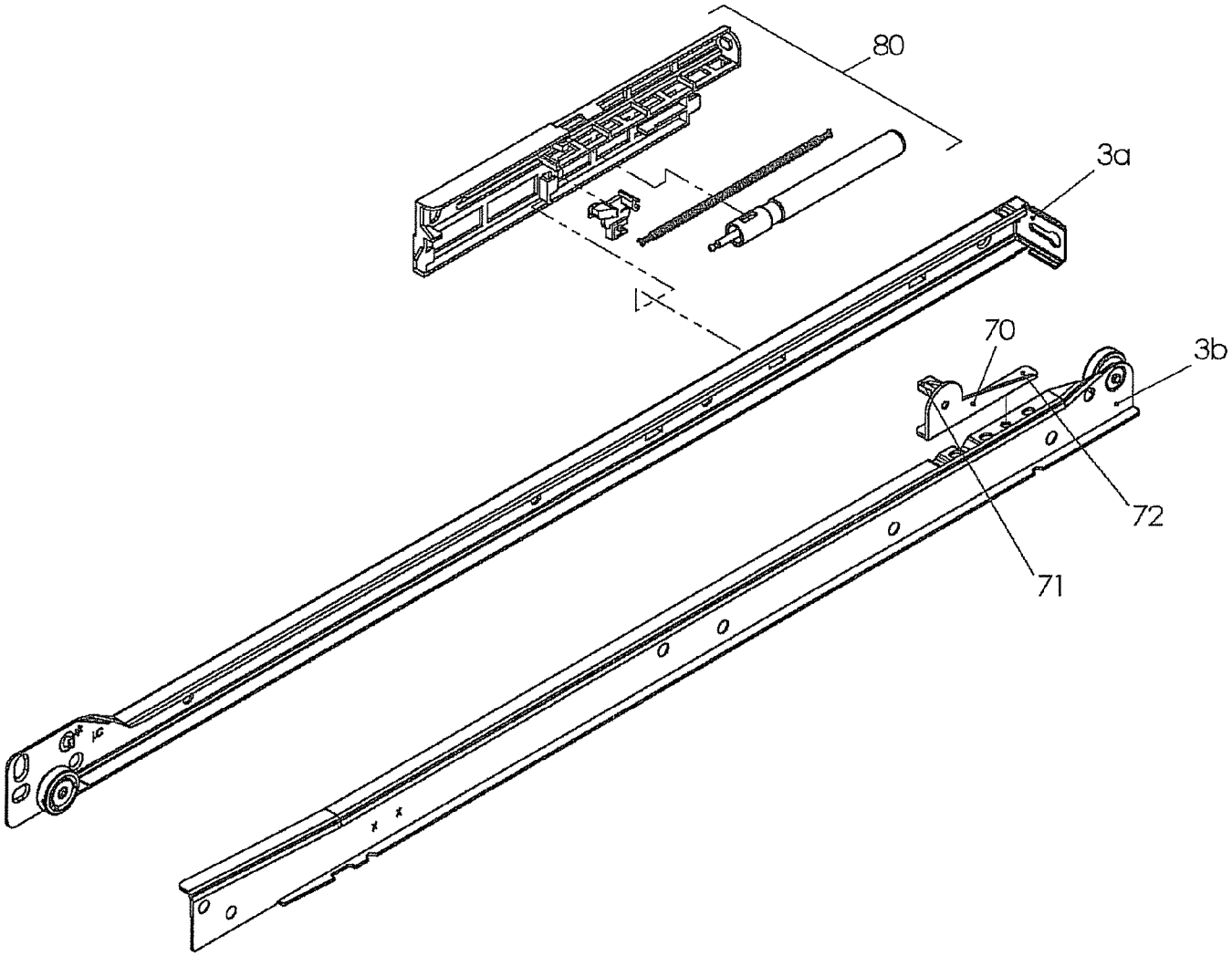
FIG. 8 is an exploded drawer-side view of the control mechanism 51 shown in FIG. 5.

Another embodiment of the present invention is shown in FIGS. 5-11 and is described in more detail below. More specifically, FIG. 5 shows a perspective view of a drawer slide control mechanism 51 according to another embodiment of the present invention in the closed state, FIG. 6 is an exploded cabinet-side perspective view of the control mechanism 51 shown in FIG. 5, and FIG. 8 is an exploded drawer-side perspective view of the control mechanism 51 shown in FIG. 5.

The drawer slide control mechanism 51 is provided in conjunction with cooperating drawer rails, namely a cabinet rail 3*a* and a drawer rail 3*b* having a wheeled rolling mechanism. While the details shown in conjunction with the drawer rail 3*b* and the cabinet rail 3*a* shown in FIGS. 5-10 may differ from those depicted in FIGS. 1-4, its should be apparent to those skilled in the art that the present invention can easily be adapted to accommodate variations in drawer slide rail designs, and the present invention is not limited to the specific embodiments shown and described herein.

Figure 11:
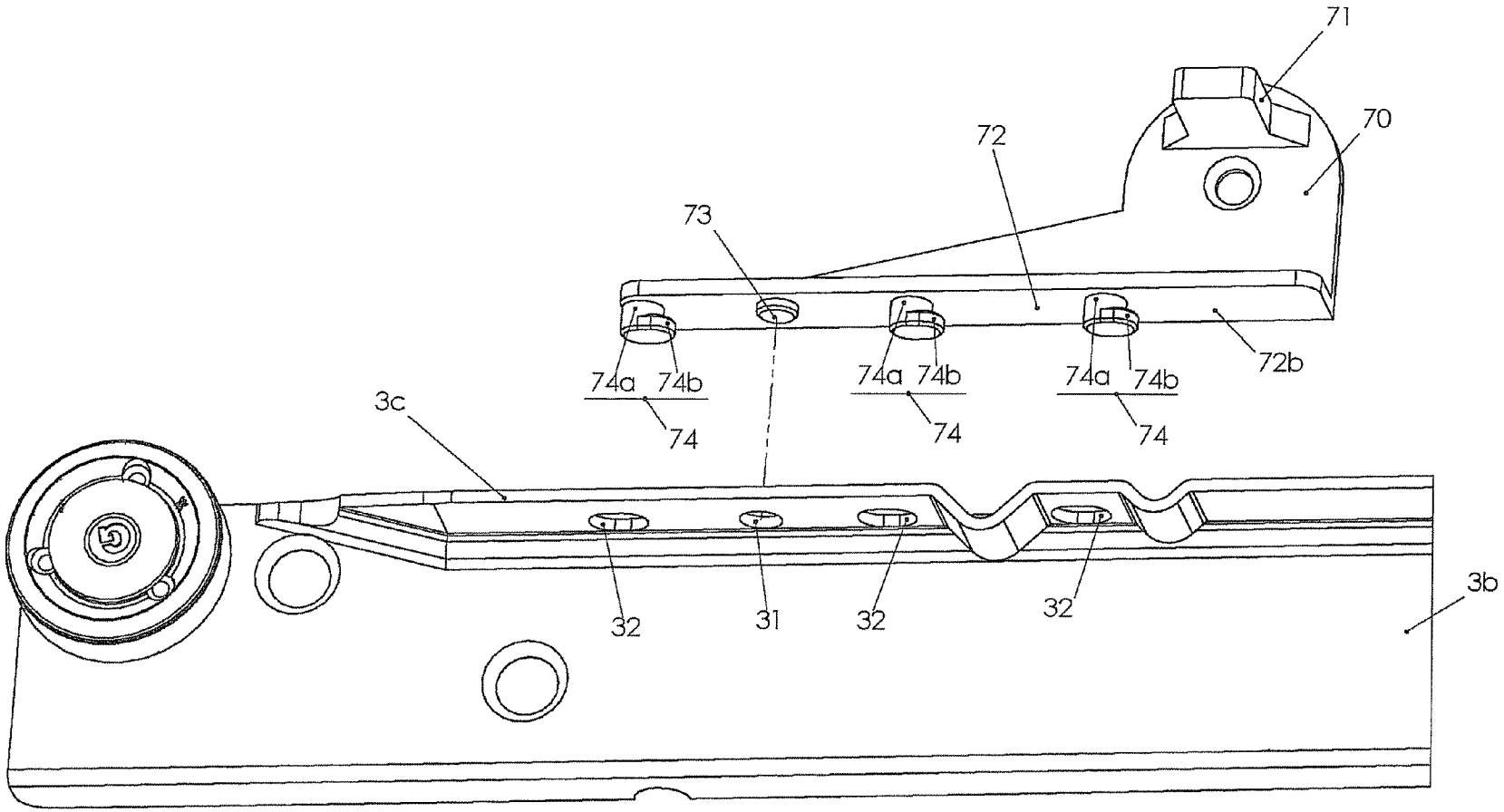
FIG. 11 is a cabinet-side, bottom perspective view showing means for mounting the drawer rail bracket 70 to a drawer rail according to the embodiment of the present invention shown in FIGS. 5, 6, 8 and 9.

FIG. 6 is an exploded, cabinet-side perspective view of the drawer slide control mechanism 51 shown in FIG. 5. The drawer slide control mechanism 51 includes a drawer latch bracket 70 having a main plain and an engagement tab 71 extending perpendicularly from an upper portion of the main plane thereof. The drawer latch bracket 70 also includes a stabilizing foot 72, which is a protrusion extending outwardly from a lower portion of the main plane of the drawer latch bracket 70, substantially parallel with respect to the engagement tab 71. As shown in FIG. 11, the bottom surface 72*b* of the stabilizing foot 72 includes a plurality of snap-fit, locking mating members 73, 74 extending downwardly therefrom. The mating members include at least one chamfered post 73 and at least a pair of posts 74 (three as shown in FIG. 11), each including a post portion 74*a* and an elongate foot portion 74*b* extending outwardly from a lower surface of the post portion 74*a*.

Figure 9:
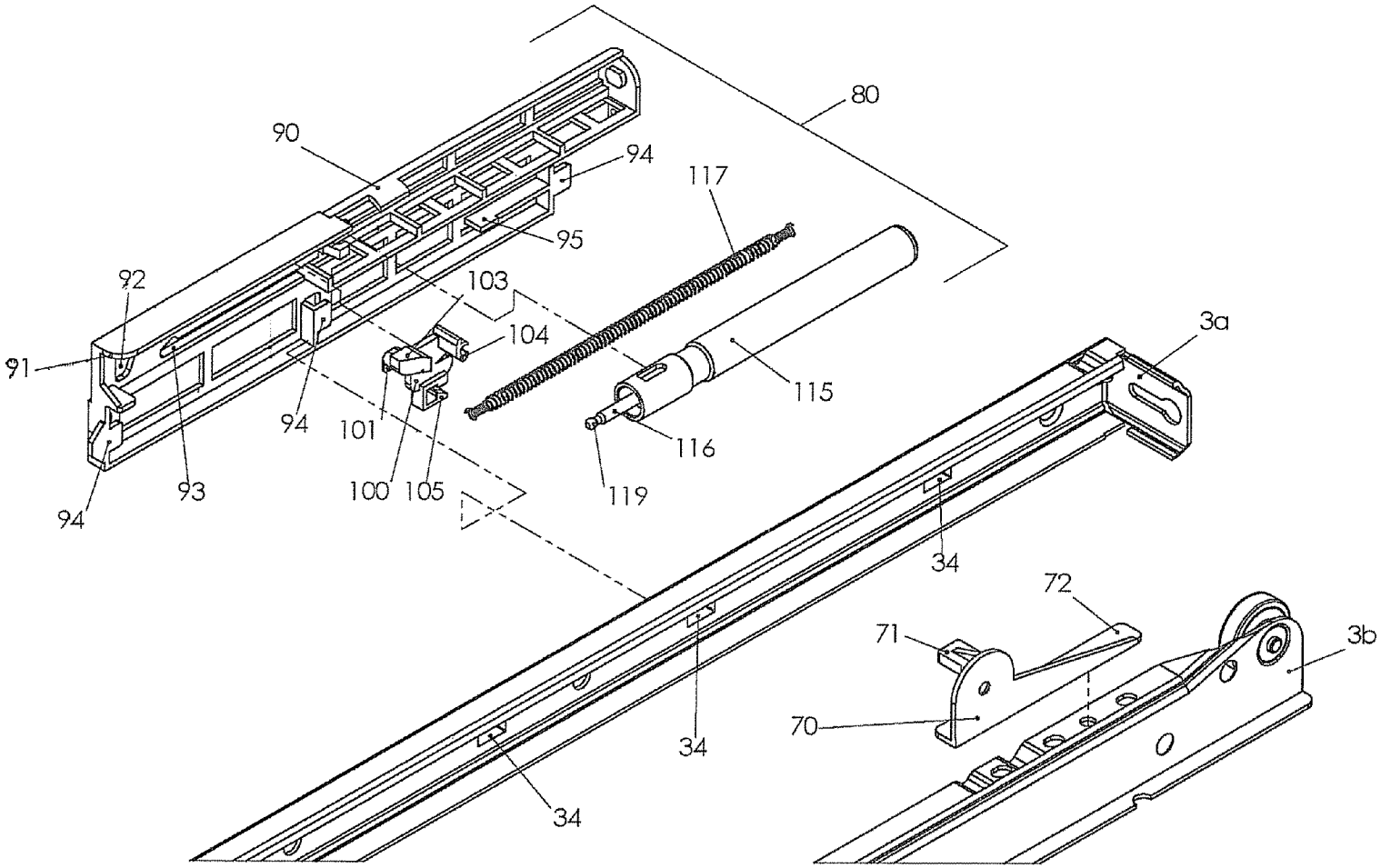
FIG. 9 is an enlarged, exploded drawer-side view of the shock absorbing sub-assembly shown in FIG. 8.

The drawer latch bracket 70 attaches directly to a surface of the drawer rail 3*b*, such as the upper surface or lip 3*c* as shown, or any other surface as dictated by the particular requirements associated with the design constraints of the drawer slide rail system. As shown in FIGS. 6, 8, 9, and as best seen in FIG. 11, the snap-fit, locking mating members 73, 74 provided on the drawer latch bracket 70 mechanically mate with and lockingly engage a corresponding mating member, such as an opening portion 31, 32 on the lip 3*c* of the drawer rail 3*b*, to quickly and easily fasten and securely hold the drawer latch bracket 70 in place on the drawer rail 3*b* without the use of tools, adhesives or other fastener members such as screws or nails or the like. It is also possible to remove the drawer latch bracket 70 from its installed position without the use of additional tools due to the spring memory characteristics of the materials from which the drawer latch bracket 70 is preferably made. The snap-fit, locking mating members 73, 74 can be reversibly disengaged from the corresponding mating members (e.g., openings 31, 32) upon the application of sufficient and specific force and direction, as one skilled in the art should readily appreciate, but will not readily disengage under the normal use circumstances of the drawer.

Means for attaching the drawer latch bracket 70 to a surface of the drawer rail 3*b* is not limited, however, and includes additional and/or alternative means such as welding, glue, adhesive tape, adhesive-backed or glue-backed hook-and-loop type fasteners, or the like, to name a few. The snap-fit, locking mating means shown in FIGS. 6, 8, 9 and 11 are preferred, however, in the context of the ease of installation, the speed of installation for both factory and aftermarket or retrofit applications, and with respect to the fact that no additional tools or fastening members or accessories are needed to facilitate the secure attachment and also removal, if necessary.

It should also be noted that the drawer latch 70 could also be directly fixed to or integrally formed with respect to a portion of the drawer side surface itself. For example, if the side face of the drawer were constructed as an integral unit to include the drawer rail extending along the length thereof, the drawer latch 70 could likewise be constructed as an integral part of the drawer rail and drawer unit.

FIG. 6A is an exploded, cabinet-side view of a control mechanism including a different latch bracket 700 according to another embodiment of the present invention. The control mechanism includes a shock absorber sub-assembly 80, which is functionally equivalent to the shock absorber sub-assembly 80 described in more detail below, a cabinet rail 3*a*, a latch bracket 700 and a drawer member 300 including a drawer rail 300*b*. As noted above, in this embodiment, the latch bracket 700 is particularly adapted to be affixed the back panel of the drawer. Since the latch bracket 700 can be affixed to the back panel of the drawer, the latch bracket 700 can be readily used in connection with a number of different metal drawers (e.g., drawer member 300) having different heights (h) ranging, for example, from 2 inches to 10 inches, depending on the desired application. In that manner, the latch bracket 700 has universal applicability with respect to such metal drawer applications, and eliminates the need for providing custom brackets for custom drawers that still match up with the other components of the control mechanism while accommodating varying drawer heights, even when custom drawers are desired.

As shown in FIG. 6A, the latch bracket 700 includes an elongate main plane 710, and the post 712 extends from a first end of the main plane 710 in a substantially perpendicular direction with respect to the main plane 710 of the latch bracket 700. The latch bracket 700 also includes a second portion 720, extending perpendicularly from an opposed second end of the main plane 710, in the opposite direction with respect to the extension direction of the post 712.

The second portion 720 includes, for example, an opening 721 through which fixing means, examples of which include, but are not limited to a screw, bolt, nail, brad, solder, or other mechanical fixing member can be inserted to affix the latch bracket 700 to the back panel of the drawer. The position of the latch bracket 700 can therefore be determined and individually installed regardless of the particular height (h) of the given drawer member 300. The second portion 720 also includes an extension 722 that can be physically manipulated (e.g., bent) as needed for alignment with the drawer rail 300*b* and to provide access to the fixing means at location 721. The extension 722 can also be affixed to the back panel of the drawer at locations 723, 724 through the fixing means described above, if needed or desired.

It should also be noted that the latch member 700 can also be readily affixed to the drawer member 300 by engaging fixing means, such as those described above, at locations 723, 724 of extension 722 of the latch bracket 700 and locations 301 of the drawer member 300, for example, so that the latch bracket 700 is securely attached to and rides with the drawer member 300. In that case, however, the structural parameters such as the height and length of the elongate main plane 710 may need to be varied depending on the given drawer height situation when the latch bracket 700 is attached to the drawer 300 so that the structural components of the control mechanism correctly interact.

Although it is not shown in FIG. 6A, the means for affixing the drawer latch 700 to the drawer member 300 at locations 723, 724 and 301, for example, could also include snap fit mating means, such as those described above in connection with FIG. 6. The materials of the drawer latch bracket 700, being metal or plastic, for example, are conducive for forming snap-fit mating members, as well as the apertures shown, as one skilled in the art would readily appreciate. In that manner, while the position of the latch bracket 700 is not strictly limited to the back panel of the drawer, the universal applicability of a single latch bracket 700 continues to reside in its ability to be affixed to the drawer back panel, and still functionally interact with the control mechanism components.

The post 712 of the latch bracket 700 interacts with the shock absorber sub-assembly 80 in the same manner described above, and the control mechanism is functionally the same as that described in connection with FIGS. 2-4. The exact structure of the latch bracket 700 is not limited to the inventive example shown and described herein. Again, the tangible benefits of this embodiment of the present invention reside in the features of the latch bracket 700 which lend to its universal applicability for metal drawers of varying heights and its functional interaction with respect to the control mechanism.

Figure 6B:
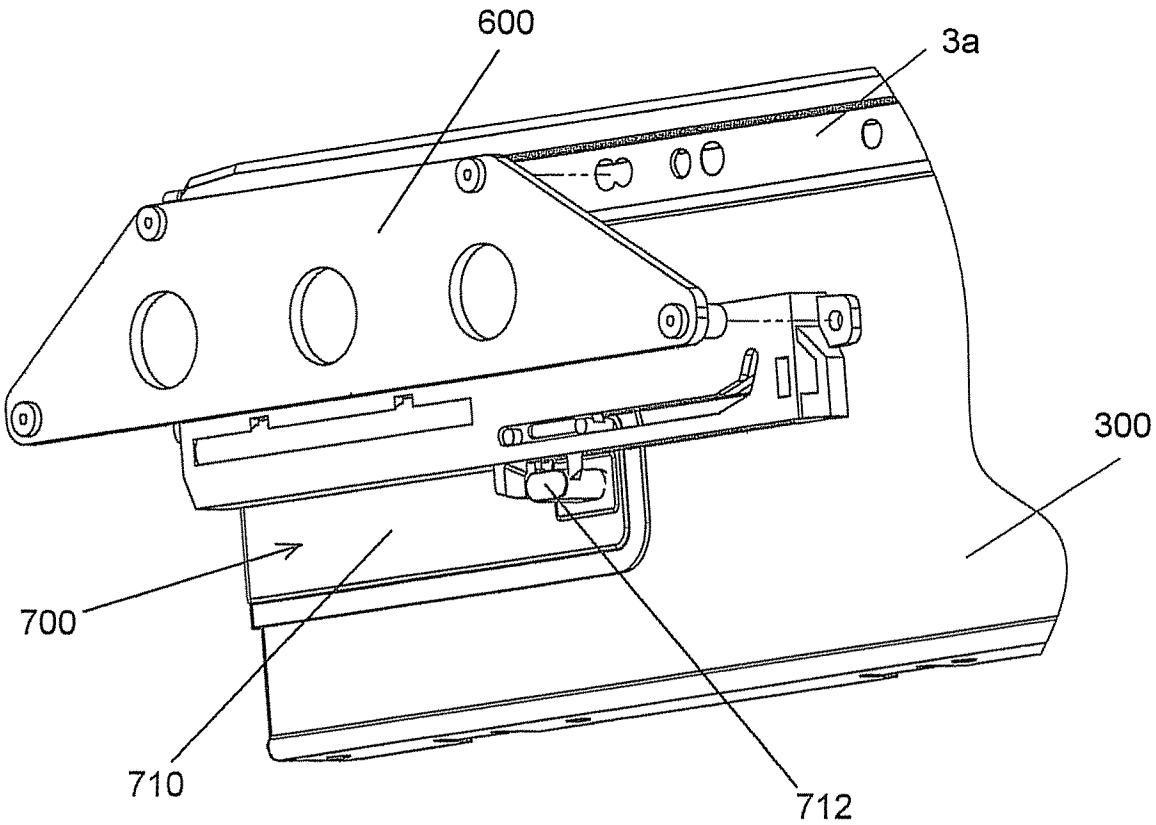
FIG. 6B is a partial perspective view of the latch bracket and control mechanism shown in FIG. 6A.

FIG. 6B is a perspective view of a cabinet rail bracket 600 fixed to cabinet rail 3*a* in conjunction with a drawer member 300 and including latch bracket 700. While minor structural modifications can be seen with respect to some features of the cabinet rail bracket 600 compared to those shown and described in FIGS. 1 and 3, for example, and the portions of the shock absorber sub-assembly 80 compared to those shown in FIGS. 4 and 6, for example, the functionality remains the same, as described below.

Figure 10:
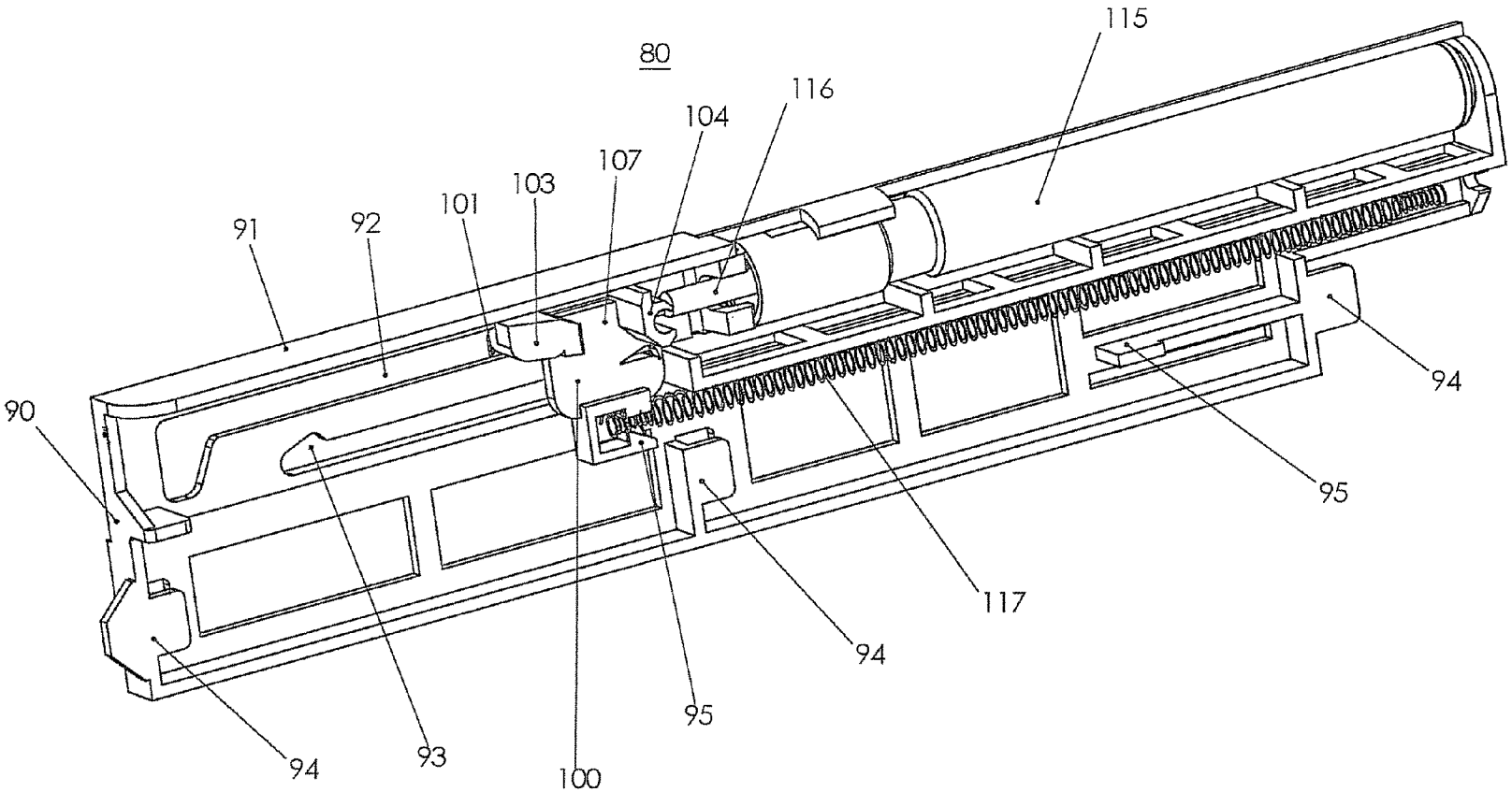
FIG. 10 is a drawer-side view of the shock absorbing sub-assembly shown in FIGS. 5-9.

The drawer slide control mechanism 51 includes a shock absorbing sub-assembly 80, which is shown in detail in FIGS. 7, 9 and 10, where FIG. 7 is an enlarged, exploded cabinet-side perspective view of the shock absorbing sub-assembly 80 shown in FIG. 6, FIG. 9 is an enlarged, exploded drawer-side perspective view of the shock absorbing sub-assembly 80 shown in FIG. 8, and FIG. 10 is a drawer-side perspective view of the shock absorbing sub-assembly shown in FIGS. 5-9.

The shock absorber sub-assembly 80 includes an elongate bracket 90 that attaches to a surface of the cabinet rail 3*a*, such as a side surface, as shown FIGS. 6-9, for example, or any other surface as dictated by the particular requirements associated with the design constraints of the drawer slide rail system. As shown in FIGS. 6, 8 and 9, a mechanical mating mechanism, such as a plurality of mating tabs 94, mechanically mates and lockingly engages with a corresponding mating portion, such as pockets 34 formed the cabinet rail 3*a*, and securely fastens in place. Although three sets of mating tabs 94 and pockets 34 are shown, any number of these or similar pairs can be provided, so long as there are at least two pairs. The elongate bracket 90 also includes another spring finger tab or protrusion 95 (see FIG. 9) that extends toward the cabinet rail 3*a* and engages the slot 35 therein (see FIG. 6). This protrusion 95 is made from a spring load memory material, as is the entire elongate bracket 90, which enables the protrusion 95 to snap into place in the slot 35 to securely affix the elongate bracket 90 to the cabinet rail 3*a* and to prevent the mating tabs 94 from disengaging the mated position with respect to the pockets 34.

Means for attaching the elongate bracket 90 to a surface of the cabinet rail 3*a* is not limited to the embodiment described above, however, and includes additional and/or alternative means such as welding, glue, adhesive tape, adhesive-backed or glue-backed hook-and-loop type fasteners, or the like, to name a few. The snap-fit, locking mating means shown in FIGS. 6-9, however, are preferred in the context of ease of installation, the speed of installation for both factory and aftermarket or retrofit applications, and the fact that no additional tools or fastening members or accessories are needed to facilitate the secure attachment and removal, if necessary.

The elongate bracket 90 also includes a lip 91 protruding outwardly from an upper portion of at least one end thereof and extending perpendicularly with respect to a planar side portion (vertically oriented, as shown) of the elongate bracket 90 in which at least one, but preferably two J-grooves 92, 93 are formed. As shown, one J-groove 92 has a crooked terminal end that bends at an angle, e.g., downwardly, with respect to the main extension axis of the remainder of the groove 92, and another J-groove 93 is positioned below the J-groove 92 and has a crooked terminal end that bends at an angle, e.g., upwardly, with respect to the main extension axis of the remainder of the groove 93. It should be understood that the relative size, position, orientation (the direction in which the tip of the angled terminal end bends) of the J-grooves can be selected depending on the design constrains of the particular drawer and cabinet configuration.

The shock absorber sub-assembly 80 also includes a movable latch 100, whose two posts 101, 102 (see, e.g., FIG. 7) respectively reside within and glide along the J-grooves 92, 93 of the elongate bracket 90, in a similar manner as described above and as described in more detail below. The post 101, which resides and glides within the J-groove 92, acts in concert with the drawer return spring 117 and the shock absorber 115, as described below, whereas the post 102 resides and glides within the J-groove 93. The provision of the second post 102 and the second J-groove 93 in this manner improves the stability of the overall structure by providing a parallel glide channel and supports the position and movement of the movable latch 100 along the elongate bracket 90 to ensure a smooth stroke.

The movable latch 100 thereby attaches to the elongate bracket 90, whereby the piston holding/engaging member 104 portion of the movable latch 100 that holds and engages the pivotable pin 119 (see FIG. 7) of piston 116, which is connected to the shock absorber 115 and is snap-fit within the elongate bracket 90 as shown in FIGS. 7 and 10, for example. The spring receiving clamp member 105 portion of the movable latch 100 receives and retains and end portion of the drawer return spring 117, which is also housed within in the elongate bracket 90, as shown in FIG. 10.

The movable latch 100 also includes a stopper member or catcher 103 that extends outwardly from an upper end portion of the movable latch 100, positioned so that a tab 71-receiving space 107 is provided between an inner surface of the catcher 103 and an inner surface of the piston holding member 104 portion of the movable latch 100.

The operation of the drawer slide control mechanism 51 according to the above-described embodiment of the present invention will now be explained with reference to FIGS. 5 and 9. FIG. 5 shows the drawer 2 in the fully closed position, whereas FIG. 9 is an exploded view of the components parts for better understanding of the opening and closing operation in connection with the following description.

In the closed position, the engagement tab 71 extending from the drawer latch bracket 70 is positioned in a space 107 between the catcher 103 and the piston holding member 104 of the movable latch 100. As the drawer 2 is opened and moves away from the cabinet housing 1, the engagement tab 71 engages the catcher 103 forces the movable latch 100 to slide along the J-grooves 92, 93 until the forward post 101 of the movable latch 100 rests within the angled tip end of the J-groove 92, as can be appreciated from FIG. 9, for example. At this terminal point, the forward end of the movable latch 100 is lifted upwardly in an angled manner to a sufficient degree so that the engagement tab 71 clears catcher 103 and moves therepast, with the catcher 103 now residing within the bent end portion of the J-groove 92. The remainder of the opening stroke continues without affecting the drawer slide control mechanism 51, and allows the drawer 2 to be fully opened relative to the cabinet housing 1. That is, the bent terminal end of J-groove 92 is shaped such that it performs a temporary locking function with respect to the position of the movable latch 100, and the position of the movable latch 100 will be maintained as shown until a drawer closing stroke is performed to re-engage the mechanism.

When the opened drawer 2 is then closed, during a closing stroke in the opposite direction, the engagement tab 71 on the drawer latch bracket 70 moves back toward the drawer slide control mechanism 51 and engages the catcher 103 on the movable latch 100 and forces the post 101 out of the terminal end portion of the J-groove 90. At this point, the drawer return spring 117 draws the movable latch 100 back toward the cabinet housing 1 until the drawer 2 is fully closed. At the same time, however, the shock absorber 115 dampens the return stroke of the movable latch 100, and thus the drawer 2, so that the drawer 2 is not subject only to the closing force applied to the drawer and the common force provided by the drawer return spring 117. With the aid of the shock absorber 115, the velocity of the closing stroke is slowed and the force is reduced so that the drawer does not close abruptly with respect to cabinet housing 1. The result is a smooth and gentle closing action of the drawer 2 relative to cabinet housing 1.

In the event that the post 101 is dislodged from the temporary locking position provided by the terminal end portion of the J-groove 92, which would force the movable latch 100 back to its initial position, it would still be possible to return drawer 2 to its fully closed position manually. Specifically, the catcher 103 is resilient enough to allow the engagement tab 71 to deflect the catcher 103 upwardly to a sufficient extent for the engagement tab 71 to clear the catcher 103 to essentially reset the position of the engagement tab 71 in the space 107 between the catcher 103 and the piston holding member 104 of the movable latch 100. At this point, the drawer slide control mechanism 51 is reset and again ready for use in the manner described above.

Each of the component parts described above can be made from any one of a variety of materials that are typically used in the construction of drawer and cabinet hardware assemblies, including, but not limited to plastic, metal, composite, or any other suitable material. If any of the parts are to be formed integrally as described above, the respective parts would likely be made of the same material, preferably plastic to reduce cost.

In a similar manner, there is no special requirement for the shock absorber 15 or 115, and a variety of linear-type shock absorbers are available in the market. The damping characteristics and stroke length of the shock absorber would, of course, have to be selected so as to meet the particular damping and stroke requirements for the drawer slide control mechanisms 5, 51 as described above. The shock absorber 15, 115 can contain a fluid such as a gas, like air or any other suitable gaseous damping fluid, or a liquid, such as an oil or any other suitable liquidous damping fluid.

While the present invention has been particularly shown and described with reference to the preferred mode as illustrated in the drawings, it will be understood by one skilled in the art that various changes in detail may be effected therein without departing from the spirit and scope of the invention as defined by the claims.

What is claimed is:

1. A drawer slide assembly control mechanism comprising:

a cabinet rail associated with a cabinet housing and a drawer rail including a wheeled rolling mechanism associated with a drawer; and a control mechanism associated with the drawer, said control mechanism comprising a drawer latch bracket positioned on at least one of said drawer rail and the drawer, said drawer latch bracket having an engagement tab extending outwardly therefrom, and a shock-absorbing sub-assembly comprising an elongate bracket member attached on said cabinet rail, said elongate bracket member comprising mating means for engaging corresponding mating means provided on said cabinet rail to establish a secure, snap-fit, mated structure, said mating means of said elongate bracket member comprising a plurality of protrusions having shapes that matingly fit and lockingly engage said corresponding mating means in said cabinet rail, which comprise corresponding openings, said elongate bracket member being fixed to a back portion or said cabinet rail that is located distal from a front portion of said cabinet rail proximate an opening, of said cabinet housing, a movable latch associated with said elongate bracket member and cooperating with said engagement tab of said drawer latch bracket so as to move in concert with movement of said drawer rail over at least a portion of a length of said drawer rail, and a shock absorber associated with said elongate bracket member and cooperating with said movable latch for damping movement of said movable latch at least during a closing stroke of said drawer rail.

2. The drawer slide assembly control mechanism according to claim 1, wherein said elongate bracket member comprises at least one groove having a main portion extending in a direction that is substantially parallel with respect to an extension axis of said cabinet rail, the groove also having an angular bent terminal end portion that deviates from said extension direction; and wherein said movable latch comprises at least a first post extending outwardly therefrom in a direction that is substantially perpendicular to said extension axis of said cabinet rail and that resides in and rides along said at least one groove of said elongate bracket member, a catcher extending outwardly in an angled manner from an upper forward end of said movable latch proximate said first post, a member for engaging said shock absorber, a member for engaging a drawer return spring, and a space provided between said catcher and said member for engaging said shock absorber;

wherein, when said drawer is in a closed position, said engagement tab extending from said drawer latch bracket is positioned in said space between said catcher and said member for engaging said shock absorber of said movable latch, and as the drawer is opened during an opening stroke, said engagement tab engages said catcher and forces said movable latch to slide along said at least one groove until said first post of said movable latch rests within said angular bent terminal end portion of said at least one groove, whereby said forward end of said movable latch is lifted upwardly in an angled manner to a sufficient degree so that said engagement tab clears said catcher and moves therepast, so that said catcher resides within said angular bent terminal end portion of said at least one groove; and wherein when said drawer is closed, during a closing stroke in an opposite direction with respect to a direction of said opening stroke, said engagement tab on said drawer latch bracket engages said catcher on said movable latch and forces said first post of said movable latch out of said angular bent terminal end portion of said at least one groove, at which point said drawer return spring draws said movable latch in the closing stroke direction, and at the same time, said shock absorber dampens said closing stroke to provide a smooth and gentle closing action of said drawer.

3. The drawer slide assembly control mechanism according to claim 2, wherein said elongate bracket member comprises at least two said grooves, and said movable latch comprises at least a second post associated with a second one of said at least two grooves.

4. The drawer slide assembly control mechanism according to claim 1, wherein said drawer latch bracket is fixed to a back panel of the drawer.

5. The drawer slide assembly control mechanism according to claim 1, wherein said drawer latch bracket comprises mating means for engaging corresponding mating means provided on said drawer or said drawer rail to establish a secure, mated structure.

6. The drawer slide assembly control mechanism according to claim 5, wherein said mating means establish a secure, snap fit, mated structure.

7. The drawer slide assembly control mechanism according to claim 6, wherein said mating means of said drawer latch bracket comprise a plurality of protrusions having shapes that matingly fit and lockingly engage said corresponding mating means in said drawer rail, which comprise corresponding openings.

8. The drawer slide assembly control mechanism according to claim 1, wherein said drawer rail including a wheeled rolling mechanism is a side-mount wheeled drawer rail.

9. The drawer slide assembly control mechanism according to claim 1, wherein said drawer rail including a wheeled rolling mechanism is an integral part of a side surface of said drawer.

10. A drawer slide assembly control mechanism comprising:

a cabinet rail associated with a cabinet housing and a drawer rail including a wheeled rolling mechanism associated with a drawer; and a control mechanism associated with the drawer, said control mechanism comprising a drawer latch bracket positioned on at least one of said drawer rail and the drawer, said drawer latch bracket having an engagement tab extending outwardly therefrom, and a shock-absorbing sub-assembly comprising an elongate bracket member attached on said cabinet rail and, said elongate bracket member comprising mating means for engaging corresponding mating means provided on said cabinet rail to establish a secure, snap-fit, mated structure, said mating means of said elongate bracket member comprising a plurality of protrusions having shapes that matingly fit and lockingly engage said corresponding mating means in said cabinet rail, which comprise corresponding openings, said elongate bracket member comprising at least one groove having a main portion extending in a direction that is substantially parallel with respect to an extension axis of said cabinet rail and the groove also having an angular bent terminal end portion that deviates from said extension direction, said elongate bracket member being fixed to a back portion of said cabinet rail that is located distal from a front portion of said cabinet rail proximate an opening of said cabinet housing, a movable latch associated with said elongate bracket member and cooperating with said engagement tab of said drawer latch bracket so as to move in concert with movement of said drawer rail over at least a portion of a length of said drawer rail, and a shock absorber associated with said elongate bracket member and cooperating with said movable latch for damping movement of said movable latch at least during a closing stroke of said drawer rail.

* * * * *

UNITED STATES PATENT AND TRADEMARK OFFICE

CERTIFICATE OF CORRECTION

PATENT NO. : 8,678,528 B2
APPLICATION NO. : 13/011269
DATED : March 25, 2014
INVENTOR(S) : Georg Domenig, Manfred Peer and Jeffery Morgan It is certified that error appears in the above-identified patent and that said Letters Patent is hereby corrected as shown below:

Title Page, Item (60) Related U.S. Application Data

Please add: This application is a Continuation in Part of PCT/US2009/051508 filed July 23, 2009.

Signed and Sealed this
Tenth Day of June, 2014

Michelle K. Lee

Michelle K. Lee
*Deputy Director of the United States Patent and Trademark Office*